428-408 SR
PTH25 XR 4,061,811

United States Patent [19]
Takase et al.
[11] 4,061,811
[45] Dec. 6, 1977

[54] ANTISTATIC CARPET AND PRODUCTION THEREOF

[75] Inventors: Hideo Takase, Shiga; Toyota Ishii; Shiro Nishiumi, both of Ohtsu, all of Japan

[73] Assignee: Toray Industries Inc., Tokyo, Japan

[21] Appl. No.: 663,819

[22] Filed: Mar. 4, 1976

[30] Foreign Application Priority Data

| | | |
|---|---|---|
| Mar. 5, 1975 | Japan | 50-26462 |
| Mar. 5, 1975 | Japan | 50-26457 |
| Oct. 21, 1975 | Japan | 50-142565[U] |

[51] Int. Cl.[2] ..... B32B 3/02; B05D 3/12

[52] U.S. Cl. ..... 428/95; 427/346; 427/385 R; 427/390 B; 428/97; 428/195; 428/368; 428/401; 428/902; 428/903; 428/922

[58] Field of Search ..... 428/922, 85, 95, 96, 428/97, 195, 206, 208, 367, 368, 401, 902, 903; 427/346, 385, 390 B

[56] References Cited

U.S. PATENT DOCUMENTS

| | | | |
|---|---|---|---|
| 3,746,573 | 7/1973 | Hotta et al. | 428/922 |
| 3,955,022 | 5/1976 | Sands | 428/95 |

*Primary Examiner*—William J. Van Balen
*Attorney, Agent, or Firm*—Armstrong, Nikaido & Marmelstein

[57] ABSTRACT

Antistatic pile carpet comprising carbon fibers arranged in the backing layer along the direction of pile rows.

12 Claims, 11 Drawing Figures

ANTISTATIC CARPET AND PRODUCTION THEREOF

BACKGROUND OF THE INVENTION

The present invention relates to novel pile carpet containing therein carbon fibers, having excellent antistatic property even under the humidity lower than 40% R.H., and the method for production thereof.

There have been widely used pile carpets produced by tufting synthetic fiber or natural fiber such as wool onto the primary backing.

When a man walks on such carpets, static electricity is generated by rubbing the shoe soles and the carpet. The static charge often imparts to the human body a shock by discharge, for instance, touching a metal door knob. In general such electrical shock becomes troublesome when the charge exceeds 3000 volts. On the other hand, the maximum charge of the carpets used in a room for electronic equipments such as computers, which are very sensitive to static electricity, much be kept below 1500 V.

Heretobefore, many procedures have been proposed for the prevention of the built-up of static charge.

The first is a method using conductive fibers such as metallic or metalized fibers with conventional natural or synthetic fibers as pile yarns. This method, however, impairs the surface appearance of the produced carpet because of metallic or black color of the conductive fibers themselves.

Moreover, since physical and chemical properties such as Young's modulus, elongation and dyeability of the conductive fibers are generally different from those of conventional fibers to be mixed therewith, when the pile produced therefrom is subjected to dyeing and finishing or heat treatment, the difference in shrinkage appears between the mixed fibers to impair quality of the produced carpet. Furthermore, higher antistatic effect (less than 1500 V) at a low humidity (lower than 20% R.H.) can not be attained at all by this conventional method. The second is a method using antistatic fibers.

However, the carpet produced by this method has a disadvantage lowering the antistatic effect under atmospheric humidity below 40% R.H. The third is a method adding antistatic agents or conductive powder such as metallic or carbon powder into the back coating latex.

This method, however, also has disadvantages that the antistatic effect is lowered under atmospheric humidity lower than 30% R.H., and the added agents gradually bleeds out while being used, and it is necessary to add a relatively large amount of the antistatic agent (5–35% by weight) in order to attain sufficient antistatic effect. Another conventional method is to add conductive fibers such as carbon fiber into latex (U.S. Pat. No. 3,746,573). This method had an advantage that good antistatic effect is obtained without any change in the surface appearance of the produced carpet and in the pile quality. This method has the following disadvantage.

The antistatic effect is not sufficient under an atmospheric humidity lower than 40% R.H. and a relatively large amount of carbon fibers have to be added into the latex in order to attain sufficient antistatic effect, and therefore mechanical properties of latex in the backing layer tend to deteriorate. Adding a large amount of carbon fibers, it is difficult to disperse them uniformly and the added carbon fibers aggregate to be lumps circumferentially in the back side of the produced carpet. Therefore, the adhesive power of the latex is further lowered to cause deterioration in the durability of the carpet. Moreover, in the backing process, the added carbon fibers tend to adhere to the roller to interrupt the backing process. Thus the amount of carbon fibers added into latex in this conventional method is substantially limited.

An object of the present invention is to provide novel carpets having excellent antistatic property even under the condition of humidity lower than 40% R.H.

Another object of the present invention is to provide carpets having excellent antistatic property without lowering other characteristics such as an appearance, chemical and physical properties.

A further object of the present invention is to provide carpets having excellent antistatic property, being backed with latex, containing therein a relatively small amount of carbon fibers which does not lower the adhesive property.

Those above will become more readily apparent from the following detailed description and examples.

SUMMARY OF THE INVENTION

Those objects of the present invention are accomplished by providing pile carpet comprising a primary backing bonding thereto piles and a backing layer containing therein arranged carbon fibers, said arranged carbon fibers being positioned along and between the pile rows adjacent thereto. Also, the carpet having a larger amount of the latex component along the pile rows is more preferable.

Figure 1:
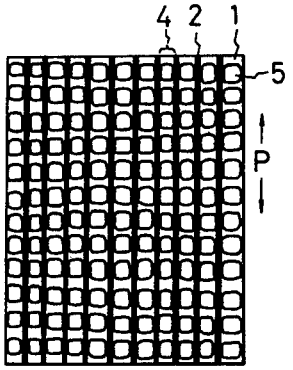
FIG. 1 is a plane view of a backing part of latex containing carbon fibers according to the present invention.
Figure 2:
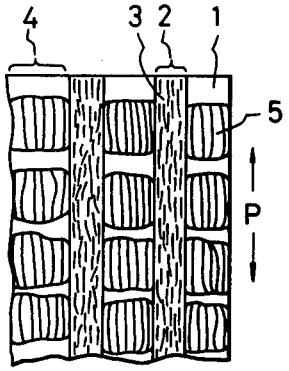
FIG. 2 is a partially enlarged plane view of FIG. 1.
Figure 3:
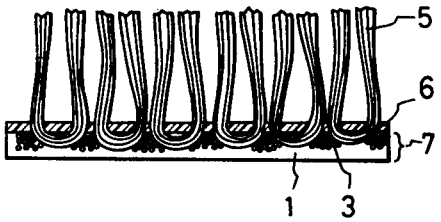
FIG. 3 is a cross sectional view of the backing part of FIG. 1.
Figure 4:
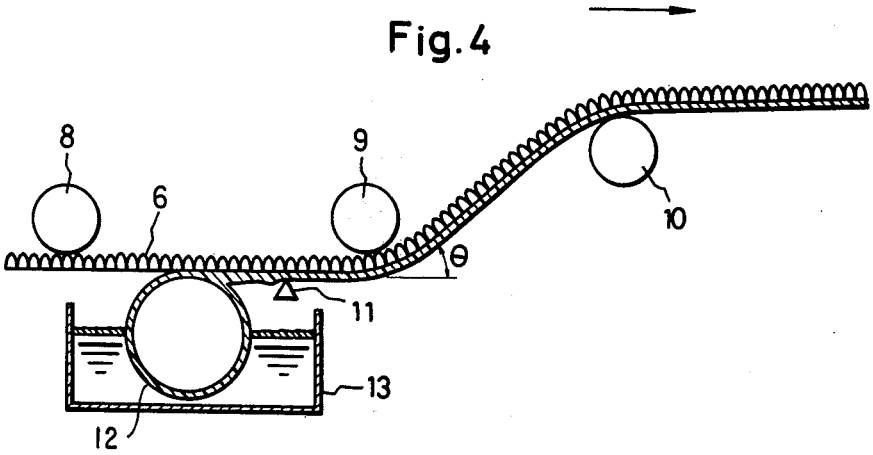
FIG. 4 shows sketch of one embodiment of production of antistatic carpet according to the present invention.

In FIGS., 1 is backing part mainly produced from conventional latex, 2 backing part containing carbon fibers, 3 carbon fibers, 4 pile row, 5 pile, 6 primary backing and 7 backing layer, respectively.

DESCRIPTION OF A PREFERRED EMBODIMENT

In order to get a sufficient antistatic carpet, when applying latex 2 containing therein carbon fibers 3 onto the back surface of a primary backing 6, which is a base cloth bonding thereto piles, uniformly dispersed carbon fibers 3 are arranged between rows 4 of pile yarns in contact with the base of pile yarns and in the direction P of the pile row in the form of long stripes in the backing material 2.

It is important that carbon fibers are arranged as long stripes between adjacent pile rows in substantially parallel with the pile rows, so that carbon fibers well contact with pile yarns and accordingly excellent antistatic property is realized in spite of a relatively small amount of carbon fibers.

It is also important that a larger amount of latex exists along pile rows, without lowering of the mechanical properties of latex.

In this invention natural and/or synthetic fibers can be used for pile yarns.

Preferable synthetic fibers are polyamide, polyester, polyolefine, polyacrylonitrile and copolymers thereof.

Fibers generally called antistatic fibers or those having specific electric resistance of less than $10^{11}\Omega$ cm at 40% RH are more preferably used. Such synthetic fibers may contain conventional chemicals such as coloring materials, plasticizers, viscosity stabilizers or other additives, if necessary. Carbon fibers to be used in the present invention designate generally carbonaceous or graphitic fibers of conductive property. Examples of them are those produced by carbonizing polyacrylonitrile fiber, rayon pitch fiber or lignin fiber. Length of the carbon fiber to be added into the latex ranges between 0.05 mm and 30 mm.

When the fibers length exceeds 30 mm, it becomes difficult to disperse carbon fibers uniformly in latex and to coat or impregnate the carbon fiber-containing latex uniformly onto the primary backing cloth.

When the fibers are shorter than 0.05 mm, the antistatic property becomes insufficient. Amount of carbon fibers added into the latex depends on various factors such as weight of carpet, height of the pile or length of carbon fiber, however, usually ranges between 0.008 and 1.0% by weight, more preferably 0.01 and 0.9% by weight based on the solid content of latex. When the weight of carbon fibers is less than 0.008%, the carpet would not exhibit sufficient antistatic property. When the weight of carbon fibers exceeds 10.0%, it brings difficulties in coating or impregnating operation.

Specific electric resistance of the carbon fiber is preferably $1.6 \times 10^{-3} \sim 2.3 \times 10^{-3}\Omega$cm at 20° under 40% RH.

Specific gravity of the carbon fiber is preferably 1.6 ~ 2.3.

When the specific gravity of the carbon fibers is less than 1.6, the fibers tend to fly about in the mixing operation, and it is difficult to arrange in the same direction in the coating process. When the specific gravity exceeds 2.3, it becomes difficult to disperse the carbon fibers uniformly in the latex. In order to arrange the carbon fibers in parallel with pile rows, carbon fibers having high specific Young's modulus (Young's modulus/specific gravity) are preferably used.

Carbon fibers having Young's modulus of 20,000 - 45,000 kg/mm$^2$ and a diameter of $4\mu$ to $26\mu$ are more preferably used. Latex for back-coating may be chosen among natural rubber, styrene-butadiene rubber, acrylonitrilebutadiene rubber, polyvinyl chloride, polyethylene, polyurethane and so on.

Such materials may contain conventional chemicals such as hardner, coloring materials, plasticizers, stabilizers, activators or other additives, if necessary. Mixing of the carbon fibers with the latex is carried out by an ordinary method such as roll-kneading or solvent dispersion. A roll mill, a colloid mill or an ultrasonic device is also preferably used.

Coating of latex onto the primary backing can be carried out by ordinary methods such as impregnation, coating, spraying, extrusion or combination thereof.

So called pick-up-roller method using lick roller and coating methods using coating machine such as reverse roller are examples of preferable methods.

Drying of the backing layer is preferably carried out by heating system of forced air circulation.

According to the present invention, antistatic carpet is produced by coating the latex containing therein carbon fibers onto the primary backing, which is a base cloth previously tufted thereto piles, and then inclining the coated primary backing while latex is in fluid state to arrange the carbon fibers in the direction of gravity.

In FIG. 4, 8 - 10 are supporting rollers, 11 doctor knife, 12 lick roller and 13 latex bath. Latex is coated onto the primary backing 6 by Lick roller 12, excess latex is scratched out by doctor knife 11.

Then the primary backing coated latex thereon is inclined to arrange the added carbon fibers in the direction of gravity, and therefore the carbon fibers are arranged along and between pile rows and the arranged carbon fibers are fixed by heating.

Figure 5:
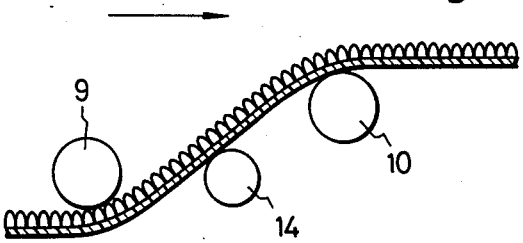
FIGS. 5 – 8 show sketches of other embodiments of production thereof.

In FIG. 5, while the latex-coated primary backing is inclined and latex is still in fluid state, horizontal force is imparted to the backing layer (in the horizontal direction of the layer) by means of supporting roller 14 to arrange the carbon fibers in the backing layer in the horizontal direction and therefore to arrange them along the direction of pile rows, and then the arranged carbon fibers are fixed by heating.

Figure 6:
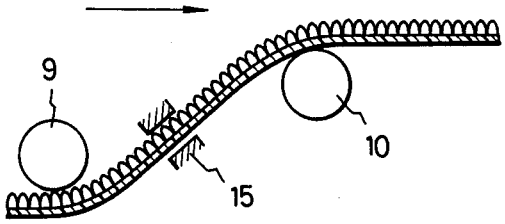
Figure 7:
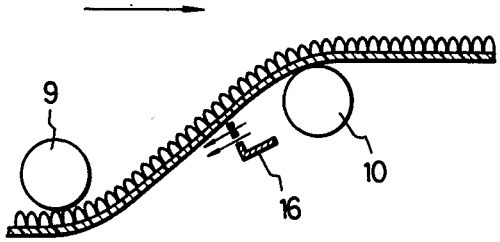
Figure 8:
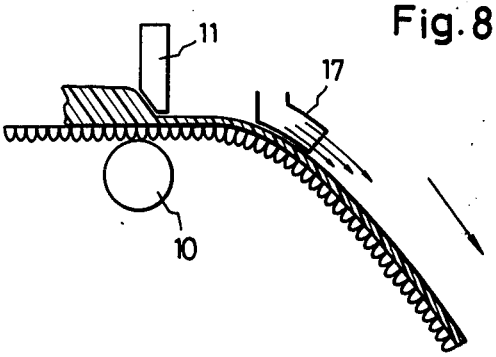

FIG. 6 shows a method of using slit 15 in lieu of supporting roller in FIG. 5. FIG. 7 shows a method of blowing air from nozzle 16 having many fine holes in the derection of the backing layer.

Horizontal force to the inclined backing has to be imparted during latex is still in fluid state, which is preferably between 5 seconds to 5 minutes after the latex is applied on the primary backing.

The reason why the carbon fibers in the latex are arranged in parallel with pile rows when horizontal force is imparted to the latex layer on the primary backing by inclining it depends on the characteristics of the carbon fibers of the remarkable high specific Young's modulus (Young's modulus/specific gravity).

Preferable inclining angle $\theta$ of the latex-coated primary backing changes with various factors such as material, shape or weight of pile, primary backing, viscosity or solid content of the latex, length of the added carbon fibers and so on.

In general, the inclining angle ranges between 5° - 80°, more preferably 8° - 70° against the surface of the latex bath. When the inclining angle is below 5° or beyond 80°, the carbon fibers are not arranged in sufficient uniformity or the backing layer tends to flow and the backing layer tends to become move irregular in the direction of gravity.

Viscosity of latex preferably ranges between 10 - 300 poise at 25° C.

The arranged carbon fibers in the backing layer of the carpet in the present invention can be seen by observation of the back surface by means of a magnifier of 20 times after tearing off the secondary backing.

It can be observed by the above method that the number of the carbon fibers arranged along and between piles rows are at least two times as much as those of the other positioned carbon fibers.

According to the present invention, antistatic carpets having various degrees of antistatic effect can be easily obtained by changing factors relating to carbon fiber, such as its length or its amount to be added, and factors relating to the arrangement of the carbon fibers, such as inclining angle of the latex-coated primary backing, the force thereto by roll or slit, the viscosity of latex or time to impart the force.

Figure 9:
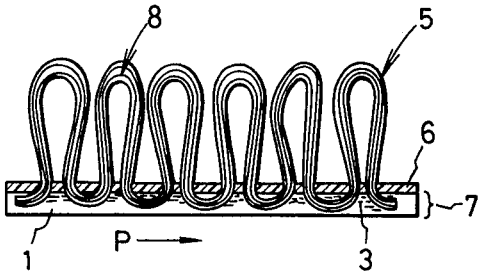
FIG. 9 is a cross sectional view of a backing part, in which pile yarn is mixed with conductive fibers.
Figure 10:
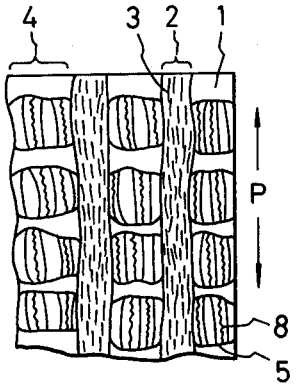
FIG. 10 is a plane view of the backing part of FIG. 9.
Figure 11:
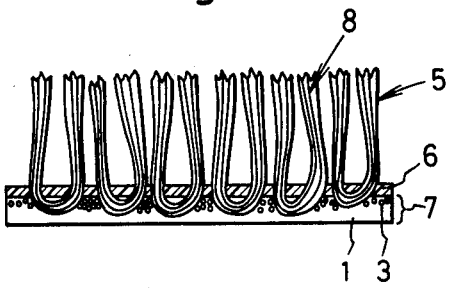
FIG. 11 is a cross sectional view in which the piles in FIG. 9 are cut.

In addition to above embodiment of the present invention, as shown in FIGS. 9 - 11, the carpets having pile yarns 5 containing therein conductive fibers 8 exhibit remarkable antistatic property even under the condition of 20% RH.

Preferable conductive fibers to be used are metallic fibers, metallic whisker, metallized yarns, conventional fibrous-, film like- or ribbon like-materials containing therein or coating thereon conductive substances and so on. Such conductive fibers are preferably used in the form of blended or twisted yarns with conventional fibers. Pile yarn produced therefrom generally has a specific electric resistance less than $10^6\Omega$cm. Any kinds of pile yarns can be used in the present invention.

Mixing ratio of the conductive fibers is preferably less than 8% by weight, more preferably less than 6%, based on the pile weight. Even in the mixing ratio less than 3% and more than 0.05%, good antistatic property is realized. When 8% of the conductive fiber is mixed, the antistatic property of the carpet is almost perfect. When the mixing ratio is below 0.05%, it is difficult to connect the conductive fibers with the carbon fibers in the backing materials.

The body voltage shown below is measured as follows.

Carpet of 1 m × 2 m is placed on a floor insulated with polyethylene foam.

The build-up of static charge on a person walking on the carpet (over 50 steps) under the conditions of 20° C and 20% RH is measured by an usual apparatus. We used a Kasuga's tester.

Durability of antistatic power is measured as follows.

The carpet is placed on a floor of a ticket gate of some crowded station. The body voltage is measured after walking of 200,000 people and 800,000 people.

Specific electric resistance is measured as follows.

A bundle of fibers of 1,000 denier is put into a bag made of polyester tricot and then washed in an aqueous solution of 0.2% by weight of nonionic detergent at 40° C for 60 minutes. After such washing is repeated 3 times, it is subjected to three times of rinsing with fresh water for 5 minutes and to dehydration and again to two times of rinsing with fresh water for 5 minutes and finally to dehydrating and drying. The sample cut 20 mm in length is conditioned at 20 ± 2° C under 40% RH for 24 hours, and then the specific electric resistance is measured by means of a tester manufactured by Kawaguchi Denki Co.

According to the present invention, the carbon fibers in the backing layer are arranged along and between pile rows adjacent thereto, respectively, accordingly the carbon fibers well contact with pile yarns.

Because of such structure of the carpet, the static charge generated on the surface of carpet is efficiently transferred to the back side of the carpet, spreaded all over the back side through the carbon fibers, then discharged therethrough into air or ground, and therefore a relatively small amount of carbon fibers exhibits excellent antistatic property in comparison with conventional techniques.

Such structure also imparts good effect to the mechanical properties of latex, such as its strength of the backing layer therefrom and its adhesive property. Also, according to the present invention, as the surface of pile yarns does not have to be treated, and other qualities of the surface appearance carpet are not impaired.

Also in case of using pile yarns mixed therewith conductive fibers according to the present invention, the antistatic effect is remarkably improved, and the appearance of carpet is not impaired because the mixing amount of conductive fibers is small. Use of the substantially conductive fibers also make it possible to decrease the amount of carbon fibers to be used. It is known that the amount of conductive fibers used for cut pile carpet is about 1.0% by pile weight, 0.1% for loop pile carpet in order to get the same antistatic effect. However, according to the present invention, even in cut pile carpet the mixing amount of about 0.1% by weight is sufficient as well as in loop pile carpet.

Hereinafter the present invention is further explained by examples.

EXAMPLE 1

100% nylon 6 yarns were subjected to stuffing process to produce the crimped yarns. The crimped yarns were tufted to produce carpet having pile height of 5 mm and pile weight of 520 g/m².

Carbon fibers of a diameter of 8μ and an average length of 3 mm were mixed with SBR latex at the mixing ratio of 0.19% by weight of the carbon fibers based on the solid content of latex.

As shown in FIG. 5, the mixed latex was coated onto the primary backing at the weight of 950 g/m², after 9 seconds, horizontal force was imparted by roll 14 and a jute was applied thereon as a secondary backing and was heated at 145° C for 16 minutes. (Sample No.1) For observation, the secondary backing of the carpet was torn off, the back surface of the carpet was examined by means of magnifier.

The carbon fibers added were dispersed between adjacent pile rows and were arranged lengthways (in the direction of tufting) in parallel. On the other hand, carpet produced by conventional backing method (Sample No.2) appeared a lot of marine ripple in the back surface. The carpets thus obtained were completely dried in a dryer at 80° C, and were conditioned for 24 hours under the conditions of 20° C, 20% RH.

The test results are shown in Table 1 in which remarkable antistatic effect is recognized with the arranged carbon fibers in the backing layer.

Table 1

| Sample No. | Body voltage (KV) | Note |
|---|---|---|
| 1 | − 2.1 | The present invention |
| 2 | − 4.5 | Control |

EXAMPLE 2

A mixture of block polyetheramide having 40% polyethylene oxide segment, 0.2% by weight of $TiO_2$ and nylon 6 was melt-spun.

The modified polyamide yarns thus obtained which had 1.5% by weight of polyethylene oxide segments, specific electric resistance of $9 \times 10^8\Omega$cm, 2,600 denier and 144 filaments, were subjected to stuffing process to produce the crimped yarns (A). Crimped yarns (B) of 100% nylon 6 were produced in the same manner mention above.

Specific electric resistance of the yarn (B) was $2 \times 10^{14}\Omega$cm. Both crimped yarns were tufted to produce carpet having pile height of 9 mm and pile weight 1,050 g/cm$^2$, respectively.

Carbon fibers of a diameter of 9 - 10$\mu$ and a length of 8 mm were mixed with conventional SBR latex at the mixing ratio of 0.28% by weight of the carbon fibers based on the solid content of latex. The mixed latex was coated on the primary backing of the carpet and the carbon fibers in the latex were arranged by the same method mentioned in Example 1.

Carpets produced by conventional backing method were compared. The test results are shown in Table 2.

Table 2

| | Pile yarn | Amount to be added | Body voltage (KV) | Durability of antistatic effect 20,000 people walkings | Durability of antistatic effect 60,000 people walkings |
|---|---|---|---|---|---|
| Control I | nylon (B) | none | 19.8 | 20.7 | 20.9 |
| Control II | same | carbon fiber no arranged | 5.1 | 5.9 | 6.5 |
| Present invention | same | carbon fiber arranged | 2.8 | 2.9 | 3.0 |
| Control III | anti-static nylon (A) | none | 15.5 | 16.4 | 17.2 |
| Control IV | same | carbon fiber no arranged | 4.2 | 4.6 | 5.8 |
| Present invention | same | carbon fiber arranged | 1.9 | 2.2 | 2.1 |

As being clear from Table 2, the carpets of the present invention have lower body voltage and excellent durability of antistatic effect in comparison with the conventional carpets. Relationship between the addition amount of carbon fibers and the effect thereof are shown in Table 3. Carpets used in this experiment were produced by the same method explained in Example 1, in which pile yarn was nylon (A), pile weight was 880 g/m$^2$, latex was of SBR and length of carbon fiber was about 4 mm.

As is clear from Table 3, over 1.0% by weight of the addition amount of carbon fibers, it becomes difficult to arrange them in parallel with the tufting direction and accordingly the antistatic effect tends to decrease.

Table 3

| Amount of carbon fiber (wt %) to be added | Body voltage (KV) | Arrangement of carbon fiber | Pulling-out strength of pile (kg/one pile) | Adhesive strength (g/cm) |
|---|---|---|---|---|
| 0 | 1.54 | — | 4.7 | 495 |
| 0.005 | 7.6 | good | 4.9 | 490 |
| 0.01 | 2.0 | good | 4.8 | 493 |
| 0.03 | 2.1 | good | 4.7 | 490 |
| 0.07 | 1.6 | good | 4.9 | 505 |
| 0.10 | 0.9 | good | 5.1 | 512 |
| 0.20 | 1.2 | good | 5.2 | 525 |
| 0.40 | 1.0 | good | 5.5 | 561 |
| 0.70 | 1.2 | good | 5.1 | 547 |
| 0.90 | 1.4 | good | 4.7 | 502 |
| 1.0 | 2.8 | slightly bad | 3.6 | 428 |
| 1.5 | 3.7 | bad | 3.3 | 220 |
| 2.3 | 4.1 | bad | 3.0 | 215 |

Note: 1) ,2) —according to JIS L 1021

EXAMPLE 3

Chips were prepared from the same block polyether amide as these used in Example 1 and then immersed in an aqueous solution of 20% by weight of sodium dodecyl benzene sulfonate at 90° C for 60 minutes. The block polyether amide absorbed 26% be weight of sodium dodecyl benzen sulfonate.

After drying, the chips of block polyether amide were mixed with 0.2% by weight of $TiO_2$ and chips of polyethylene terephthalate and melt-spun to produce polyester yarn containing therein 0.6% by weight of polyethylene oxide segments and 0.16% by weight of sodium dodecyl benzene sulfonate, whose specific electric resistance was $6 \times 10^8\Omega$cm at 40% RH.

After dyeing and crimping treatments, cut pile carpet having pile height of 8 mm and pile weight of 875 g/m$^2$ was produced by using the above yarns for piles.

Carbon fibers of 12 mm in length were mixed with conventional SBR latex at the mixing rate of 0.08% by weight based on the solid content. The latex thus obtained was spread onto the primary backing of the carpet and, as shown in FIG. 7, air was blown horizontally against the spreaded surface at the blowing rate of 0.8 m/sec. for 2 minutes by means of nozzle 16, and then a jute was applied thereon as a secondary backing and was heated at 145° C for 15 minutes. (Sample No.1) In the back side of the carpet after tearing off the second backing, the carbon fibers were uniformly dispersed between adjacent pile rows as stripes and arranged lengthways (in the machine direction) in parallel.

In comparison therewith, carpet (Sample No.2) in which carbon fibers were not used but other conditions were the same as above, and carpet (Sample No.3) in which carbon fibers were not arranged because only conventional backing treatment was applied, but other conditions were the same as above were produced.

The test results are shown in Table 4.

Table 4

| Sample No. | Body voltage (KV) | Note |
|---|---|---|
| 1 | 2.8 | present invention |
| 2 | 12.9 | control |
| 3 | 4.3 | control |

Sample No.1 shows excellent antistatic effect, but other control samples show body voltage greater than 4 KV and accordingly impart great discharging shock.

EXAMPLE 4

980 g of SBR latex was applied on carpet of 1 m$^2$ produced from wool pile of 8 mm height and jute backing. (Sample No.1)

In comparison therewith, carpet (Sample No. 2), in which carbon fibers (8$\mu$ of diameter, 9 mm of length) were added in latex at the mixing ratio of 0.92% by weight based on the solid content, was produced by conventional backing method (the carbon fibers were not arranged) and carpet (Sample No. 3) was produced by the same method explained in Example 3 (the carbon fibers were arranged).

The test results are shown in Table 5.

Table 5

| Sample No. | Body voltage (KV) |
|---|---|
| 1 | 19.6 |
| 2 | 3.9 |
| 3 | 1.7 |

Sample No.3 according to the present invention shows excellent antistatic effect.

EXAMPLE 5

Using pile yarns of 2,600 denier of 100% nylon 6, produced a tufted carpet having level loop of 1,295 g/m² pile weight.

Mixed yarns of metallic filaments of 8μ diameter and nylon filaments were used as pile yarn of several piles rows.

As shown in FIG. 7, latex mixed therewith carbon fibers was coated on the primary backing of the carpet, the coated backing was inclined to 38° under non dried state, and air was blown horizontally against the surface through nozzle. The carbon fibers were arranged along and between pile rows.

In comparison therewith, carpets in which carbon fibers were not arranged along pile rows were produced (Control III).

Carpets were produced by conventional backing method using conventional SBR latex (Control II).

Carpets were produced in the same manner explained above but metallic yarn was not used at all (Control I).

In the above cases, the carbon fibers of 6 mm length were added to latex at the ratio of 0.085% by weight based on the solid content and the coating weight was 1.3 kg/m², respectively.

The carpets thus obtained were placed on floors insulated with 100% polyethylene foam. The build-up of static charge on a person with leather shoe soles walking on the carpet (over 50 steps) under the condition of 20° C and 20% was measured by means of Kasuga's tester. The results are shown in Table 6.

Durability of antistatic effect was measured as follows. The carpets were placed on floors of ticket gate of a crowded station and body voltage after walking of 200,000 people and 800,000 people were measured.

Table 6

| | Mixed number of mixed yarn of metallic yarn of 8μ and nylon 1) | Additive to latex (wt %) | Body voltage (−V) | Durability of antistatic effect 200,000 people walking | Durability of antistatic effect 800,000 people walking | Difficulty in tufting 2) | Surface quality of pile 3) |
|---|---|---|---|---|---|---|---|
| Control 1 | non | Carbon fiber (0.085) | 8,500 | 8,700 | 9,200 | 0 | 0 |
| Control II | 1/2 | non | 2,500 | 3,900 | 6,200 | Δ | × |
| | 1/6 | non | 3,300 | 4,400 | 6,000 | Δ~0 | Δ~0 |
| | 1/12 | non | 3,600 | 5,000 | 6,300 | 0 | 0 |
| Control III | 1/2 | Carbon fiber (0.085) | 1,900 | 3,000 | 3,500 | Δ | × |
| | 1/16 | same | 2,200 | 2,900 | 3,500 | 0 | 0~Δ |
| | 1/12 | same | 2,600 | 3,600 | 4,500 | 0 | 0 |
| the present invention | 1/2 | same | 800 | 900 | 1,200 | Δ | × |
| | 1/6 | same | 1,000 | 1,200 | 1,200 | 0 | Δ~0 |
| | 1/12 | same | 1,000 | 1,400 | 1,400 | 0 | 0 |

Note)
1) Mixed number . . . . . (mixed number)/(total piles rows), for instance, 1/2 means one pile row in two piles rows has mixed stainless steel monofilament.
2) difficulty in tufting . . . Δ: some diffcult, 0 : normal
3) surface quality of pile . . . ×: greatly coarse, Δ: coarse, 0 : no coarse As shown in Table 6, the body voltage differs from each other between the case of arranged carbon fibers and the other case, the carpets by the present invention show body voltage less than 1,500 V and excellent antistatic effect and durability.

What is claimed is:

1. An antistatic pile carpet comprising a primary backing of a base cloth, a plurality of rows of pile yarn tufted through the base cloth and a backing layer of a latex having carbon fibers dispersed therein, said carbon fibers having a diameter of from 4μ to 26μ and a length of from 0.05 mm to 30 mm and being positioned between and along the rows of pile yarn and being arranged parallel to the rows.

2. Antistatic pile carpet according to claim 1, in which large part of latex component of the backing layer exists along the pile rows.

3. Antistatic pile carpet according to claim 1, in which the dispersed amount of the carbon fibers in the backing layer is 0.01 to 0.9% by weight based on the weight of the backing layer.

4. Antistatic pile carpet according to claim 1, in which the carbon fibers have a specific gravity of about 1.6 to 2.3

5. Antistatic pile carpet according to claim 1, in which the carbon fibers have a Young's Modulus of 20,000 to 45,000 kg/mm².

6. Antistatic pile carpet according to claim 1 wherein said pile yarn includes conductive fibers of specific electric resistance less than $10^{11}\Omega$cm at 40% RH.

7. Antistatic pile carpet according to claim 6, in which latex component of the backing layer exists largely along the pile's rows.

8. A method for producing antistatic pile carpet which comprises coating the back surface of a base cloth having a plurality of rows of pile yarn tufted therethrough with a liquid latex having carbon fibers dispersed therein, said fibers having a diameter of 4μ to 26μ and a length of from 0.05 mm to 30 mm, and inclining the coated base cloth in the direction of the rows of pile yarn while the liquid latex is in a fluid state to cause said carbon fibers to become arranged parallel to the rows and positioned between and along the rows.

9. Method for producing autistatic pile carpet according to claim 8, in which the latex has a viscosity of about 10 - 500 poises at 25° C.

10. Method for producing antistatic pile carpet according to claim 9, in which the coated base cloth is inclined 5° - 80° relative to the horizontal.

11. Method for producing antistatic pile carpet according to claim 8, in which air is blown horizontally against the latex coated surface while it is inclimed.

12. Method for producing antistatic pile carpet according to claim 8, in which a force is applied to the latex coated base cloth in the direction of the rows while the base cloth is inclined.

* * * * *